US005443311A

United States Patent [19]

Kadlecek et al.

[11] Patent Number: 5,443,311

[45] Date of Patent: Aug. 22, 1995

[54] PULL-OUT WORK PLATFORM FOR DRAWER

[75] Inventors: Alois Kadlecek, Bradford; Kenneth J. Laver, Richmond Hill, both of Canada; Jack A. Parise, Kenosha, Wis.

[73] Assignee: Snap-on Incorporated, Kenosha, Wis.

[21] Appl. No.: 140,846

[22] Filed: Oct. 25, 1993

[51] Int. Cl.[6] ..... A47B 88/00

[52] U.S. Cl. ..... 312/308; 312/902; 312/291; 108/90

[58] Field of Search ..... 312/308, 330.1, 334.29, 312/902, 291, 307; 108/90, 44, 143

[56] References Cited

U.S. PATENT DOCUMENTS

| | | | |
|---|---|---|---|
| 1,060,215 | 4/1913 | Stoney | 312/215 |
| 2,701,932 | 2/1955 | Hyman | 312/308 |
| 2,711,944 | 6/1955 | Meek et al. | 312/308 |
| 3,241,900 | 3/1966 | Hamilton et al. | 312/308 |
| 3,519,319 | 7/1970 | Taylor | 312/307 |
| 4,102,470 | 7/1978 | Timmons | 312/333 |
| 4,120,549 | 10/1978 | Bureau | 312/330.1 |
| 4,582,372 | 4/1986 | Cooper | 312/322 |
| 4,708,274 | 11/1987 | Roche | 108/44 |
| 5,037,165 | 8/1991 | Rapp et al. | 312/330.1 |
| 5,044,059 | 9/1991 | De Giulio | 312/308 |

FOREIGN PATENT DOCUMENTS

| | | | |
|---|---|---|---|
| 789753 | 1/1958 | United Kingdom | 319/309 |

*Primary Examiner*—Kenneth J. Dorner
*Assistant Examiner*—Janet M. Wilkens
*Attorney, Agent, or Firm*—Emrich & Dithmar

[57] ABSTRACT

A sliding work platform for a drawer includes a flat panel with depending side and rear flanges and a depending tray along the front edge thereof. The drawer side walls are respectively coupled to slide assemblies, each including a runner defining an upwardly opening channel. The platform panel spans the drawer side walls and the side flanges extend down respectively into the channels of the drawer slide runners. The length of the tray is less than the distance between the drawer side walls so that it nests within the drawer. The platform slides forwardly and rearwardly of the drawer between a forward position completely covering the drawer and a rearward position permitting access to the drawer.

19 Claims, 2 Drawing Sheets

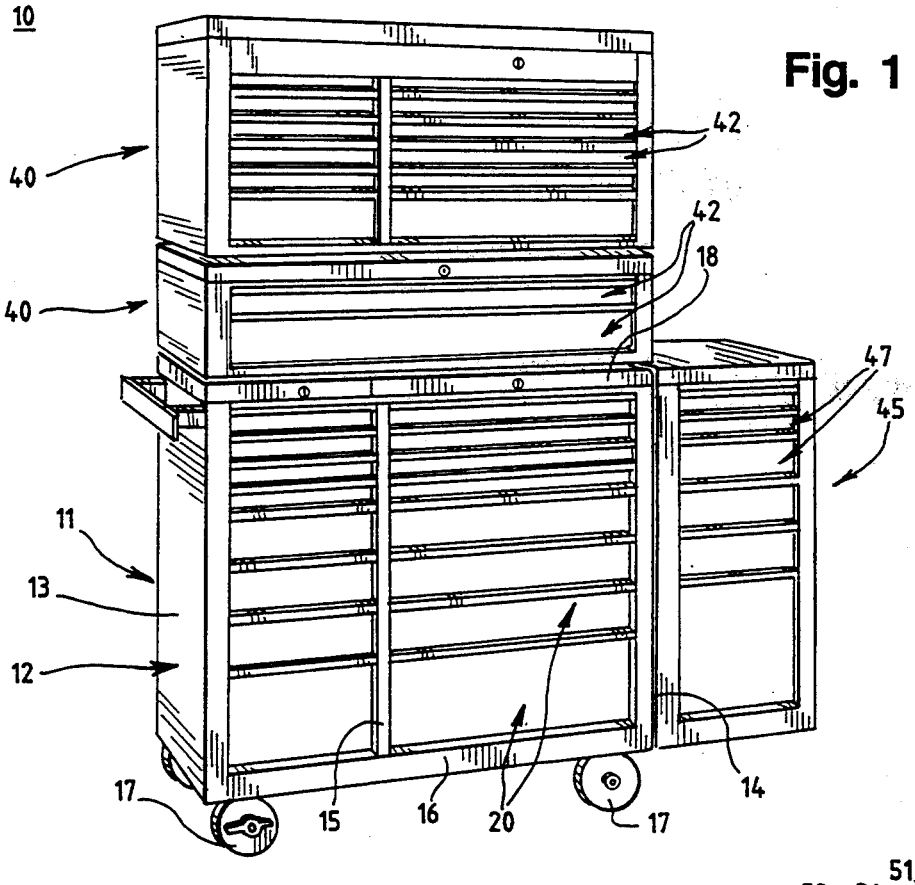
Fig. 1
Fig. 2
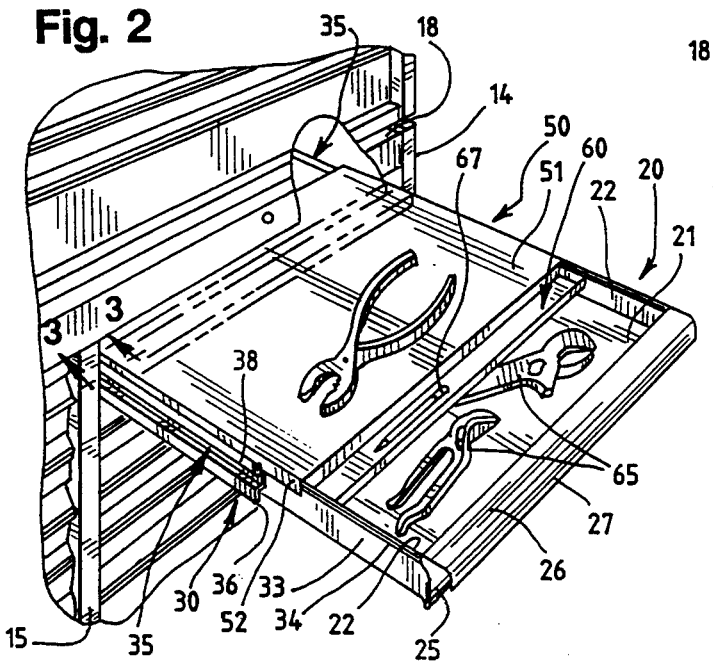
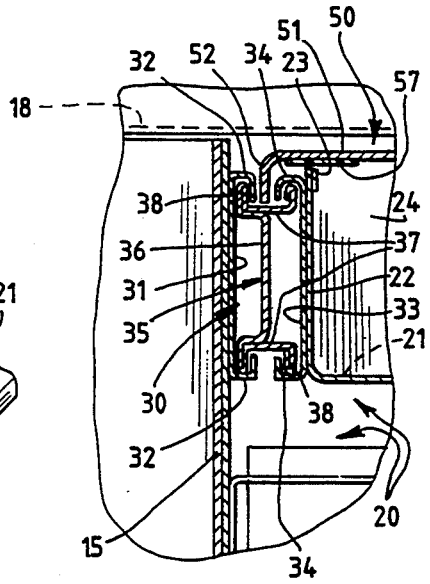
Fig. 3

PULL-OUT WORK PLATFORM FOR DRAWER

BACKGROUND OF THE INVENTION

1. Field of the Invention

The present invention relates to work platforms or surfaces adapted for use with drawers and, in particular, to platforms which are supported on the drawer for movement therewith.

2. Description of the Prior Art

It is known to provide a work surface or platform for use with a drawer. In particular, such work platforms have heretofore been provided in connection with drawered structures such as tool chests and the like. One type of work surface comprises a platform which is hinged to the drawer and is pivotally movable between a closed use position covering the drawer and providing a horizontal work surface, and a raised or open position permitting access to the portion of the drawer underlying the work platform. One such work platform is sold by Snap-on Tools Corporation for use in its KR7100 series tool cabinet. With such hinged platforms, the drawer must be pulled substantially completely out in order to permit the platform to be raised to allow access to the interior of the drawer.

It is also known to provide sliding trays supported on a drawer. Such trays typically have raised side walls with hook flanges at the upper ends thereof which respectively hook over the top edges of the drawer side walls and are slidable therealong, with the tray recessed in the drawer between the drawer side walls. Such trays are slid forwardly and rearwardly along the drawer side walls to permit access to the interior of the drawer. Thus, of necessity, the platform work surface has a front-to-back depth substantially less than the depth of the drawer since, because of the recessed nature of the tray, it cannot move beyond the front and rear walls of the drawer. Such sliding trays are sold by Snap-on Tools Corporation under Model Nos. 1000K3016 and 380K3016.

SUMMARY OF THE INVENTION

It is a general object of the invention to provide an improved work platform for use with a drawer which avoids the disadvantages of prior drawer-supported work platforms, while affording additional structural and operating advantages.

An important feature of the invention is the provision of a drawer-supported work platform which affords a work surface having an area substantially the same as the area of the drawer.

Another feature of the invention is the provision of a work platform of the type set forth which is slidably supported on the drawer for movement between a forward position covering the entire drawer and a rearward position uncovering substantially the entire drawer to permit access thereto.

In connection with the foregoing feature, another feature of the invention is the provision of a work platform of the type set forth which remains fully supported when in its rearward, drawer-uncovering position.

Still another feature of the invention is the provision of a work platform of the type set forth which is of simple and economical construction.

These and other features of the invention are attained by providing a sliding work platform for a drawer comprising: a substantially rectangular panel defining a work surface and having front and rear edges and opposed side edges, side flanges respectively integral with the panel adjacent to the side edges thereof and depending therefrom, and a narrow channel-shaped tray disposed along the front edge of the panel, the tray including a bottom wall and upstanding front and rear walls, the rear wall being integral with and depending from the panel adjacent to the front edge thereof.

The invention consists of certain novel features and a combination of parts hereinafter fully described, illustrated in the accompanying drawings, and particularly pointed out in the appended claims, it being Understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a front perspective view of a tool cabinet having a plurality of drawers of the type with which the work platform of the present invention can be used;

FIG. 2 is a fragmentary perspective view of a portion of the tool cabinet of FIG. 1, with a work platform in accordance with the present invention supported on one of the drawers, and with the drawer shown in its fully open position;

FIG. 3 is a further enlarged fragmentary view in vertical section taken along the line 3—3 in FIG. 2;

DESCRIPTION OF THE PREFERRED EMBODIMENT

Figure 4:
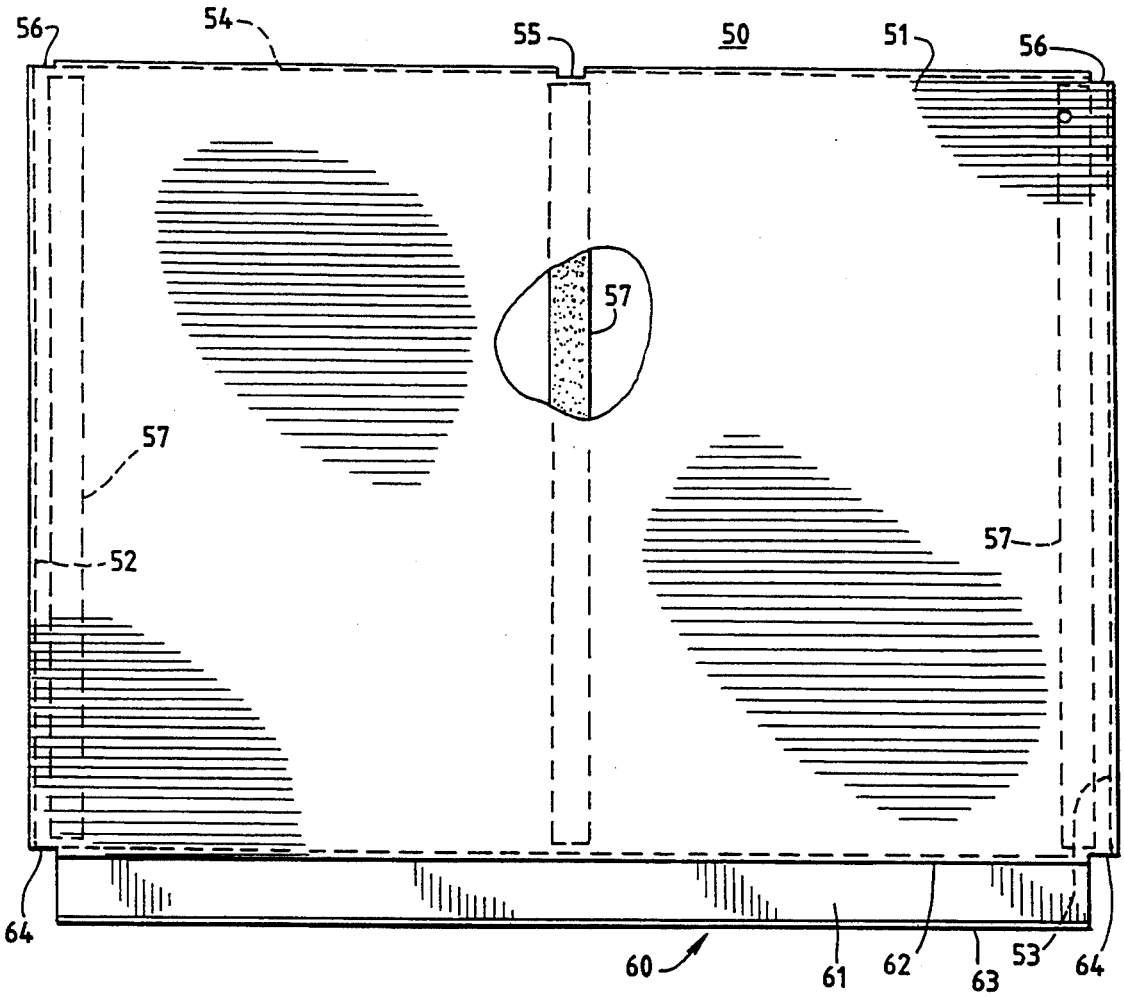
FIG. 4 is a top plan view of the work platform of FIG. 2, with a portion broken away.

Referring to FIGS. 1 and 2, there is illustrated a tool cabinet assembly 10 of the type with which the present invention can be used. The cabinet assembly 10 includes a roll cabinet module 11 having a housing 12 including upstanding side walls 13 and 14 and an intermediate wall 15 disposed between and substantially parallel to the side walls 13 and 14. The bottom edges of the walls 13–15 are interconnected by a bottom wall 16 from which depend four casters 17. The housing 12 is closed at the upper end thereof by a top wall 18. A rear wall (not shown) may also be provided in a known manner. The cabinet module 11 has a plurality of drawers 20 of various sizes, some of which are mounted between the side wall 13 and the intermediate wall 15 and some of which are mounted between the side wall 14 and the intermediate wall 15, all in a known manner.

Referring also to FIGS. 2 and 3, each of the drawers 20 typically has a flat, rectangular bottom wall 21 integral at the opposite side edges thereof with upstanding side walls 22, each of which has the upper end thereof folded back on itself to define a rolled top edge 23. The drawer 20 has an upstanding rear wall 24 (FIG. 3) and an upstanding front wall 25, which is preferably integral at the upper edge thereof with a forwardly projecting handle flange 26 provided at its distal end with a depending lip 27. It will be appreciated that the lip 27 facilitates grasping by the user's fingers to pull the drawer 20 to its open condition, illustrated in FIG. 2.

Each of the drawers 20 is supported on a pair of drawer slide assemblies 30, which may be generally of the type disclosed in U.S. Pat. No. 4,072,375. Each drawer slide assembly 30 is fundamentally of three-part construction. More specifically, each slide assembly 30 includes a cabinet track 31 fixed to the associated cabinet wall (e.g., the intermediate wall 15) having the upper and lower edges thereof bent to define channels 32. Similarly, a drawer track 33 is fixed to the adjacent side wall 22 of the drawer 20 and has its upper and lower edges bent over to define channels 34. The assembly 30 also includes a runner 35 having an upstanding rectangular main wall 36 and having the upper and lower ends thereof bent in a recurved configuration to form top and bottom channels 37, each being defined by a pair of spaced-apart walls 38 and respectively opening upwardly and downwardly. As can best be seen in FIG. 3, the spaced apart walls 38 of the bottom channel 37 of the runner 35 respectively fit into the lower channels 32 and 34 of the cabinet track 31 and the drawer track 33. Similarly, the upper channels 32 and 34 of the cabinet track 31 and the drawer track 33, respectively, hook over the spaced apart walls 38 of the upper runner channel 37. In operation, the runner 35 is reciprocatively slidable relative to the cabinet track 31 and the drawer track 33 for facilitating movement of the drawer 20 between its open and closed conditions in a known manner.

The cabinet assembly 10 may also including one or more top chest modules 40 which rest on top of the roll cabinet module 11, and each of which is provided with one or more drawers 42. The cabinet assembly 10 may also include an end cabinet module 45, which is supported on one of the side walls 13 or 14 of the roll cabinet module 11 and may also be provided with a plurality of drawers 47, all in a known manner. While the present invention is described more fully below in connection with one of the drawers 20, it will be appreciated that it could be used with any of the drawers 20, 42 or 47, or with any other drawer which is supported by the drawer slide assemblies 30 or similar slide assemblies having upper and lower runner channels corresponding to the runner channels 37.

Figure 5:
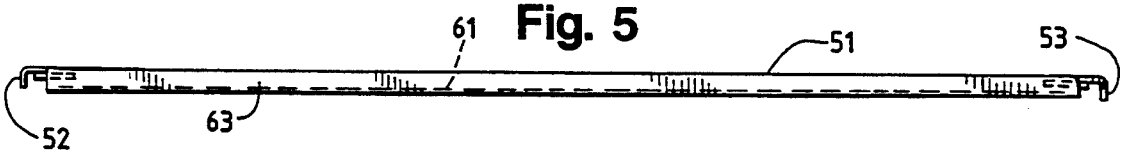
FIG. 5 is a front elevational view of the work platform of FIG. 4.
Figure 6:
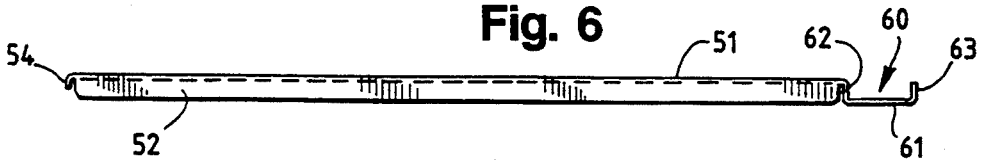
FIG. 6 is side elevational view of the left-hand side of the work platform of FIG. 4.

Referring now also to FIGS. 4–6, there is illustrated a work platform 50 constructed in accordance with and embodying the features of the present invention. The platform 50 has a flat, rectangular panel 51 unitary at its opposite side edges with depending side flanges 52 and 53, respectively. The panel 51 is unitary at its rear edge with a depending rear flange 54. A rectangular central notch 55 may be provided through the rear flange 54 and into the rear edge of the panel 51 midway between the side flanges 52 and 53 to provide clearance for a latch hook on the associated drawer 20 (not shown). The rear flange 54 does not extend the full width of the panel 51, and its ends terminate at corner notches 56 in the panel 51. Fixedly secured to the bottom surface of the panel 51, by suitable means such as adhesive, are three slide strips 57 which extend front-to-back along the panel 51. Preferably, two of the strips 57 are respectively disposed adjacent to the side flanges 52 and 53 and the other is disposed midway between the side flanges 52 and 53 in line with the center notch 55. Preferably, the slide strips 57 are formed of a suitable low-friction material.

Unitary with the panel 51 at the front edge thereof is a tray 60 which is generally channel-shaped and includes a flat rectangular bottom wall 61, unitary at the rear edge thereof with an upstanding rear wall 62 which is, in turn, unitary with the front edge of the panel 51. Unitary with the bottom wall 61 at the front edge thereof is an upstanding front wall 63. The tray 60 has a length less than the width of the panel 51 and its ends terminate at corner notches 64 in the panel 51.

Referring to FIGS. 2 and 3, in use, the work platform 50 is supported on the drawer 20. More specifically, the panel 51 spans the drawer side walls 22, with the outer ones of the slide strips 57 respectively slidably engaging the top edges 23 of the drawer side walls 22. The width of the panel 51 is greater than the width of the drawer 20, and the side flanges 52 and 53 respectively extend downwardly, respectively outboard of the drawer side walls 22 and into the upper channels 37 of the runners 35 of the drawer slide assemblies 30. Preferably, the vertical length of the side flanges 52 and 53 is such that their distal edges are disposed very closely adjacent to the bottoms of the upper runner channels 37 when the work platform 50 is supported on the drawer side walls 22, as can best be seen in FIG. 3. The rear flange 54 of the work platform 50 depends along the outer surface of the drawer rear wall 24. The tray 60 nests inside the drawer 20 between the side walls 22, as can best be seen in FIG. 2.

Thus, it will be appreciated that the work platform 50 is fully supported on the drawer 20 for movement therewith, and is also slidably movable forwardly and rearwardly relative to the drawer 20. Preferably, the work platform 50 is sized so that when it is in its forwardmost position relative to the drawer 20, it completely covers the drawer 20, thereby affording the maximum work surface area. When access to the drawer 20 is desired, the drawer 20 is opened the desired amount and the work platform 50 is slid rearwardly the desired distance to access the contents, such as tools 65, in the desired portion of the drawer 20. It will be appreciated that the tray 60 affords a finger grip to facilitate sliding movement of the work platform 50 between its forwardmost and rearwardmost positions. Also, the tray 60 provides a receptacle for utensils, such as a pencil 67 or the like.

It is a significant aspect of the invention that the work platform 50 remains fully supported in all positions. Thus, for example, when the drawer 20 is pulled all the way out to its fully open position, and it is desired to access the entire area of the drawer 20, the work platform 50 must be pushed all the way back until the tray 60 abuts the rear wall 24 of the drawer 20. In this position, the side flanges 52 and 53 of the work platform 50 project rearwardly well beyond the rear end of the drawer 20. Nevertheless, they remain supported in the top channels 37 of the drawer slide assembly runners 35.

In a constructional model of the invention, the work platform 50 is formed of a suitable metal, such as steel, and is preferably of unitary one-piece construction. However, it will be appreciated that other materials and fabrication techniques could be utilized.

From the foregoing, it can be seen that there has been provided an improved work platform which is slidably supported on a drawer for movement therewith and for sliding movement relative thereto, the work platform covering the entire area of the drawer and being slidable to an open position exposing substantially the full area of the drawer, while remaining fully supported.

We claim:

1. A sliding work platform for a drawer comprising: a substantially rectangular panel defining a work surface and having front and rear edges and opposed side edges, side flanges respectively integral with said panel adjacent to the side edges thereof and extending downwardly therefrom, a rear flange integral with said panel adjacent to the rear edge thereof and extending downwardly therefrom, and a narrow channel-shaped tray disposed along the front edge of said panel, said tray including a bottom wall and upstanding front and rear walls, said rear wall being integral with and extending downwardly from said panel adjacent to the front edge thereof, each of said rear flange and said tray having opposite ends respectively spaced a predetermined distance inboard of said side edges of said work surface.

2. The platform of claim 1, wherein said bottom wall and said front and rear walls of said tray are flat rectangular walls.

3. The platform of claim 2, wherein said platform has a notch formed through said rear flange and into said panel at the rear edge thereof substantially midway between said side flanges to provide clearance for an associated drawer latch hook.

4. The platform of claim 1, wherein each of said side flanges extends substantially the full front-to-back depth of said panel.

5. The platform of claim 1, wherein said side flanges are substantially parallel to each other.

6. The platform of claim 1, wherein said flanges and said tray are unitary with said panel.

7. In a drawer assembly having upstanding side walls with free upper edges and drawer slide assemblies respectively coupled to the outer surfaces of the drawer side walls, the improvement comprising: a sliding work platform including a substantially rectangular panel defining a work surface dimensioned for spanning said drawer side walls and extending laterally outwardly therebeyond and for slidably engaging the upper edges thereof, and side flanges respectively depending from said panel outboard of said drawer side walls and respectively overlying said slide assemblies, said platform being slidable forwardly and rearwardly relative to the drawer and to the slide assemblies, said side flanges being slidably engageable with said slide assemblies when the drawer is open and said platform is slid rearwardly relative to the drawer.

8. The drawer assembly of claim 7, wherein said panel has opposed side edges, said side flanges being respectively disposed at said side edges of said panel.

9. The drawer assembly of claim 7, wherein said side flanges are substantially parallel to each other.

10. The drawer assembly of claim 7, wherein the drawer has an upstanding rear wall and said panel has a rear edge, and further comprising a rear flange integral with said panel adjacent to the rear edge thereof and depending therefrom.

11. The drawer assembly of claim 7, wherein said panel has a front edge, and further comprising means defining a finger grip along said front edge of said panel.

12. The drawer assembly of claim 11, wherein said means defining a finger grip includes a tray having a bottom wall and upstanding front and rear walls, said rear wall being integral with and depending from said panel adjacent to the front edge thereof.

13. The drawer assembly of claim 7, and further comprising slide members fixed to the underside of said panel and disposed for sliding engagement respectively with the free upper edges of the drawer side walls.

14. In a cabinet structure including a housing, a drawer having side walls with free upper edges, and drawer slide assemblies for respectively slidably mounting the drawer side walls on the housing for reciprocating movement between fully open and closed conditions, wherein each slide assembly includes a runner defining an upwardly opening channel and being slidable relative to both the drawer and the cabinet, the improvement comprising: a sliding work platform including a substantially rectangular panel defining a work surface and having front and rear edges and opposed side edges, and side flanges respectively integral with said panel adjacent to the side edges thereof and depending therefrom, said side flanges being spaced apart a predetermined distance greater than the distance between the drawer side walls by an amount such that said platform is disposable in a use configuration with said panel resting upon the free upper edges of the drawer side walls and with said side flanges depending respectively into the channels of the slide assembly runners, said platform being slidable forwardly and rearwardly relative to the drawer and to the slide assemblies.

15. The cabinet structure of claim 14, and further comprising a narrow channel-shaped tray disposed along the front edge of said panel, said tray including a bottom wall and upstanding front and rear walls, said rear wall being integral with and depending from said panel adjacent to the front edge thereof.

16. The cabinet structure of claim 15, wherein said tray has a length less than the distance between the drawer side walls so as to be recessed within the drawer when said platform is disposed in the use configuration thereof.

17. The cabinet structure of claim 16, wherein said front and rear walls of said tray are substantially parallel to each other and substantially perpendicular to said panel.

18. The cabinet structure of claim 14, wherein the drawer has an upstanding rear wall and further comprising a rear flange integral with said platform along the rear edge thereof and depending therefrom.

19. The cabinet structure of claim 18, wherein said platform has a notch formed through said rear flange and into said panel at the rear edge thereof substantially midway between said side flanges to provide clearance for an associated drawer latch hook.

* * * * *

UNITED STATES PATENT AND TRADEMARK OFFICE

CERTIFICATE OF CORRECTION

PATENT NO. : 5,443,311

DATED : August 22, 1995

INVENTOR(S) : Alois Kadlecek et al.

It is certified that error appears in the above-indentified patent and that said Letters Patent is hereby corrected as shown below: On the title page: Item

[56] References Cited, the following should be added

-- 3,160,448 10/62 Abernathy et al.
4,072,375 2/78 Boone
4,440,461 4/84 Powell et al.
4,600,255 7/86 Dubarko
4,832,423 5/89 Rapp
5,044,780 9/91 Teramachi
5,046,861 9/91 Tarver 1182637 France Snap-on Tools Corporation Catalog, pages 16 and 31 (1992).--

Column 5, line 20, "2" should be --1--.

Signed and Sealed this

Nineteenth Day of December, 1995

Bruce Lehman

*Attest:*

BRUCE LEHMAN

*Attesting Officer*

*Commissioner of Patents and Trademarks*